US007237766B2

(12) United States Patent
Lemay

(10) Patent No.: US 7,237,766 B2
(45) Date of Patent: Jul. 3, 2007

(54) RETAINING DEVICE FOR SLATS

(75) Inventor: Gerald Lemay, 3322 Jacob-Jordan, Terrebonne, QBC (CA) J6X 4J6

(73) Assignees: Gerald Lemay, Terrebonne (Quebec) (CA); General Plastiques Extrusion, Terrebonne (Quebec) (CA)

( * ) Notice: Subject to any disclaimer, the term of this patent is extended or adjusted under 35 U.S.C. 154(b) by 42 days.

(21) Appl. No.: 10/373,014

(22) Filed: Feb. 26, 2003

(65) Prior Publication Data

US 2004/0164286 A1 Aug. 26, 2004

(51) Int. Cl.
*E04H 17/06* (2006.01)

(52) U.S. Cl. ..... 256/34; 256/1; 256/24; 52/281; 52/586.1; 403/388

(58) Field of Classification Search ..... 403/358, 403/388, 381; 256/21, 22, 24, 65.08, 73, 256/1, 34; 52/586.1, 585.1, 800.12, 800.13, 52/281, 285.1
See application file for complete search history.

(56) References Cited

U.S. PATENT DOCUMENTS 1,376,150 A * 4/1921 Miller ..... 256/72
2,590,929 A * 4/1952 Bush ..... 256/21
3,059,293 A * 10/1962 Eddleblute ..... 403/292
3,083,951 A * 4/1963 Huret ..... 256/65.08
3,113,760 A * 12/1963 Huret et al. ..... 256/21
3,572,640 A 3/1971 Vecchiarelli et al.
3,924,834 A * 12/1975 Young ..... 256/22
4,132,390 A 1/1979 Pfarr
4,586,310 A * 5/1986 Baril et al. ..... 403/358
4,942,709 A * 7/1990 Waldron ..... 52/585.1
4,950,098 A 8/1990 Abbott et al.
4,953,338 A * 9/1990 Wilson et al. ..... 52/586.2
5,193,775 A * 3/1993 Wagnon ..... 248/262
5,234,199 A 8/1993 Cluff
5,275,381 A 1/1994 Cluff et al.
5,429,581 A * 7/1995 Michaud et al. ..... 403/381
5,465,941 A 11/1995 Abbott
5,588,726 A * 12/1996 Lee ..... 403/381
5,651,533 A * 7/1997 Ling ..... 256/34
5,746,325 A * 5/1998 Lee ..... 403/381

(Continued)

FOREIGN PATENT DOCUMENTS

CA 2126804 A1 * 12/1995

(Continued)

*Primary Examiner*—Daniel P. Stodola
*Assistant Examiner*—Ernesto Garcia
(74) *Attorney, Agent, or Firm*—V. Davidge, AT

(57) ABSTRACT

Retaining device for use with two elongated slats longitudinally located in a chain linked fence. Each slat has first and second slat surfaces and first and second slat edges, and has a notch located in a portion of a slat end. The notch extends transversally from the first to the second slat edge. The device includes a cap having a first panel connected to an intermediate panel. A guide rail connects to the first panel. The guide rail has first and second spaced apart longitudinal stop ends located inwardly away from respective first and second panel side edges for cooperation with notches of respective slats. The guide rail is slidably and longitudinally engageable by the notches in generally opposed directions along restricted paths of travel from one of the stop ends toward the other one of the stop ends to retain the notches thereon.

9 Claims, 4 Drawing Sheets

U.S. PATENT DOCUMENTS 5,865,562 A * 2/1999 Mallek ..... 403/381
5,893,617 A * 4/1999 Lee ..... 403/381
5,997,209 A * 12/1999 Sachs ..... 403/388
6,039,307 A 3/2000 De Zen
6,095,503 A * 8/2000 Burley et al. ..... 256/24
6,202,987 B1 3/2001 Forbis
6,540,432 B2 * 4/2003 Albanese ..... 403/388

FOREIGN PATENT DOCUMENTS

DE 564596 A1 * 11/1932
EP 863317 A2 * 9/1998
GB 697546 A1 * 9/1953

* cited by examiner

RETAINING DEVICE FOR SLATS

FIELD OF THE INVENTION

The present invention concerns retaining caps, more particularly to retaining caps for use with slats that are located in chain link fences and the like.

BACKGROUND OF THE INVENTION

Chain link fencing is commonplace and is used to provide a barrier around such areas as private gardens and the like. Chain link fencing includes a network of wires that are intertwined to form a mesh of alternating generally rectilinear holes, which provide a discrete, almost invisible barrier. A number of horizontal and vertical support bars support the wire mesh. There may be times, however, when a user requires more privacy than the chain link fencing provides. A series of elongated plastic slats may be threaded through the holes to provide more privacy to the user and to improve the esthetic appearance of the chain link fence. Caps are typically placed onto the upper ends of the slats to keep the slats together and provide ornamentation to the upper end of the fence.

A few cap designs exist, for example, U.S. Pat. No. 5,651,533, issued Jul. 29, 1997 to Ling for "Cap for Chain Link Fence". Ling's patent discloses a cap system that includes two legs having two flexible securing fingers, which appear to resiliently engage respective slats and to secure them in place. Disadvantageously, this design appears to be only suitable for hollow type slats and may not be adaptable for use with solid slats. In addition, in the above design the securing fingers may be difficult to disengage from the slats if the user needs to disengage the slats from the chain link fence. To accommodate the cap, the slats may have to be modified using difficult precision cutting techniques. Moreover, specialized mold technology may be needed to produce the caps of the above design, which may increase the cost of the caps.

Thus there is a need for an improved retainer cap.

SUMMARY OF THE INVENTION

The invention reduces the difficulties and disadvantages of the prior art by providing a simple retaining device, which can be manufactured using conventional plastic injection die technology or extrusion technology for a relatively low cost and which is easily adaptable to chain link fencing. The device provides a secure and simple means for attachment to the slat ends, thus reducing relative movement therebetween, but which can be easily dismantled if desired. In addition, the device includes a novel cap, which has a guide rail, which extends only partially along the cap. The guide rail cooperates with slat notches, which are located halfway into the ends of each slat, in such a way that a user only needs to push laterally against the slats to move them along the guide rail to a point where the guide rail abuts the blind end of the notches, thereby securing the slats. The cap cooperates with most commercially available slats, both solid and hollow types, with minimal modification to the slats. Moreover, the notches in the slat ends can be introduced using simple lateral cutting.

In accordance with an aspect of the present invention, there is provided a retaining device for use with two elongated slats longitudinally located in a chain linked fence, each elongated slat having opposed first and second longitudinal slat surfaces and opposed first and second longitudinal slat edges, each elongated slat having a notch located in a portion of a slat end, the notch extending transversally and partially from the first slat edge substantially toward the second slat edge and through the slat from the first slat surface to the second slat surface, said device comprises: a cap member having a first panel and an intermediate panel connected to one another, said first panel having a first panel surface thereof; said intermediate panel being adapted for covering the slat end of the first and second slats and a guide rail connected to said first panel, said guide rail extending along said first panel and outwardly from said first panel surface, said guide rail having first and second spaced apart longitudinal stop ends located inwardly away from respective said first and second panel side edges, said guide rail having a first retainer lip connected to a guide rail edge thereof at about 90 degrees relative thereto, said guide rail edge and said first retainer lip substantially extending from said first stop end to said second stop end, said guide rail being configured to be slidably engaged by the notches of the two slats as the two slats are moved toward one another from the first and second stop ends of the guide rail with said first panel and said first retainer lip being substantially parallel to and adjacent a respective one of the first and second slat surfaces of each one of the first and second slats and retaining said slats therebetween.

Typically, the guide rail further includes: a second retainer lip substantially opposed to said first retainer lip and connected to said guide rail edge at about 90 degrees relative thereto, said second retainer lip substantially extending from said first stop end to said second stop end.

In one embodiment, the guide rail is connected to said first panel at about 90 degrees relative thereto.

Typically, each notch is defined by first and second notch sidewalls and a notch blind end, said stop ends substantially abutting respective notch blind ends when retaining the notches thereon.

Typically, the guide rail is frictionally engageable by the first and second notch sidewalls.

In one embodiment, the guide rail is of sufficient size to accommodate elongated slats of various dimensions.

In one embodiment, the intermediate panel includes: first and second intermediate panel edges; and a third retainer lip connected to said first intermediate panel edge at about 90 degrees and depends therefrom.

Typically, the first panel is connected to said second intermediate panel edge at about 90 degrees relative thereto.

Typically, the cap member further includes a second panel, said second panel being connected to said intermediate panel at a location generally equidistant between said first and second intermediate panel edges.

Typically, the second panel is connected substantially perpendicular to said intermediate panel.

Typically, the first, second and third retainer lips are generally coplanar, said first, second and third retainer lips and said first panel surface are frictionally engageable by the first and second slat surfaces, respectively.

Typically, the first and second stop ends are located equidistant from respective said first and second panel side edges.

In one embodiment, the first and second stop ends are located adjacent respective said first and second distal panel side edges, a distance between said first and second distal panel side edges being of a length narrower than a length of said intermediate panel.

In one embodiment, the first panel includes a panel bottom edge disposed away from said intermediate panel, said guide rail is located generally equidistant between said distal panel bottom edge and said intermediate panel.

In one embodiment, the second panel includes two concave side edges and a convex upper edge therebetween.

In one embodiment, the cap member is sized to be located over both slats when said device retains said slats thereon.

In accordance with another aspect of the present invention, there is provided in combination, for mounting on a chain linked fence: first and second elongated slats longitudinally locatable in the chain linked fence, each elongated slat having opposed first and second longitudinal slat surfaces and opposed first and second longitudinal slat edges, each elongated slat having a notch located in a portion of a slat end, said notch extending transversally from said first slat edge toward said second slat edge; and a retaining device as defined hereinabove to releasably retain said first and second slats thereon when mounted on the chain link fence.

In one embodiment, in which each one of said notches is defined by first and second notch sidewalls and a notch blind end, each of said first and second stop ends substantially abutting respective said notch blind ends when retaining said notches thereon.

Typically, the notch blind end is located substantially equidistant from said first and second slat edges.

In one embodiment, the first and second slats are hollow.

Typically, the intermediate panel substantially covers said slat end of both said first and second slats when retained thereon.

BRIEF DESCRIPTION OF THE DRAWINGS

Further aspects and advantages of the present invention will become better understood with reference to the description in association with the following Figures, wherein.

DETAILED DESCRIPTION OF THE PREFERRED EMBODIMENTS

Figure 1:
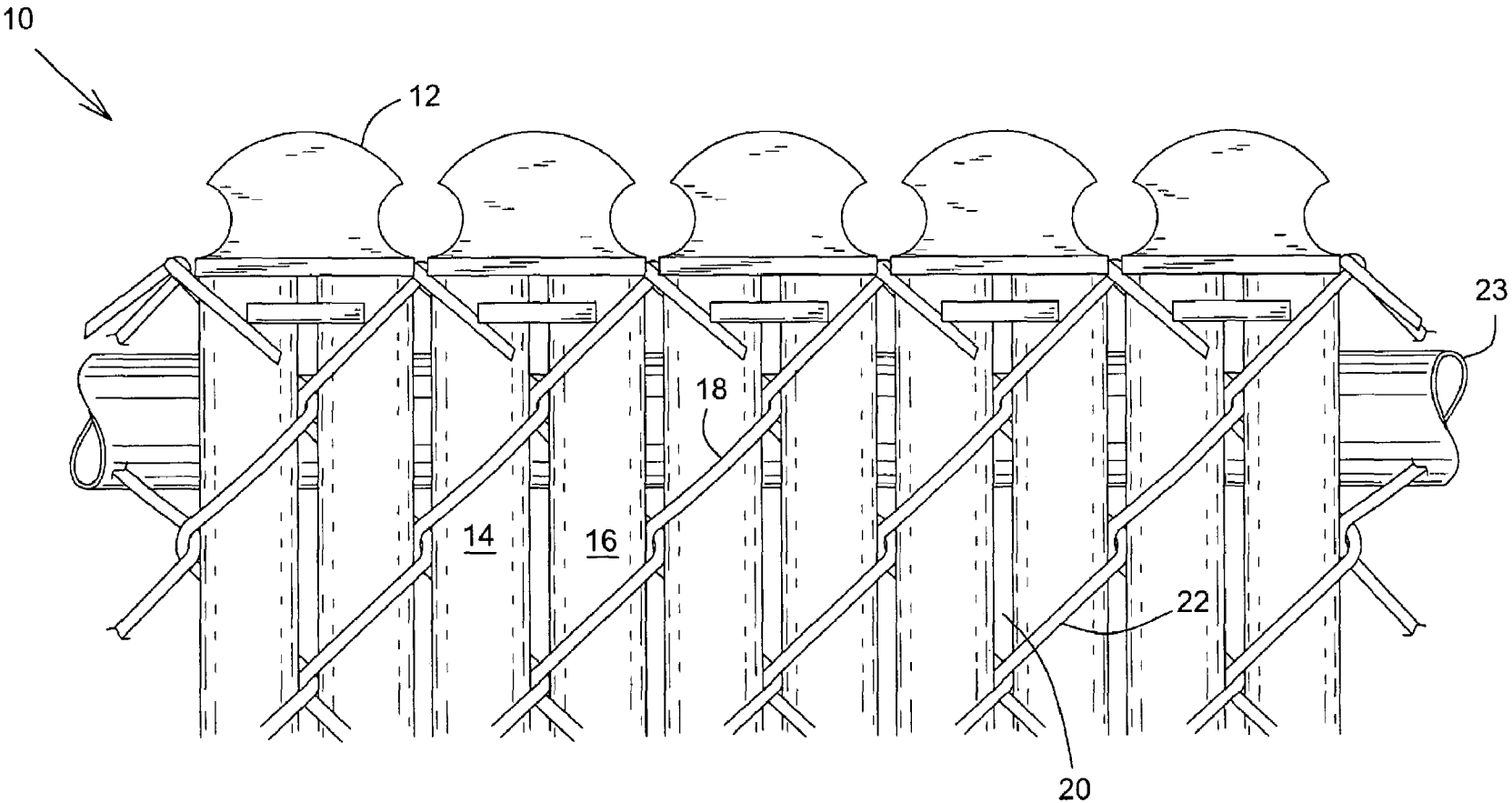
FIG. 1 is a perspective view of a plurality of retaining devices located in a chain link fence.

Referring to FIG. 1, a retaining device of the present invention is shown generally at 10. Generally speaking, the retaining device 10 includes a cap 12 for retaining two adjacent elongated slats 14 and 16. The slats 14 and 16 are typically located adjacent each other in a chain link fence 18, where they are weaved through a plurality of rectilinear holes 20 that are defined by wire 22 and supported by a frame 23. Both the cap 12 and the slats 14, 16 are typically made of plastic, PVC, HDPE or some other lightweight, resilient and weather-resistant material known to those skilled in the art. The cap 12 is typically dimensioned so that, when in position over the slats 14,16, it covers them and retains the slats 14, 16 in a secure manner.

Figure 3:
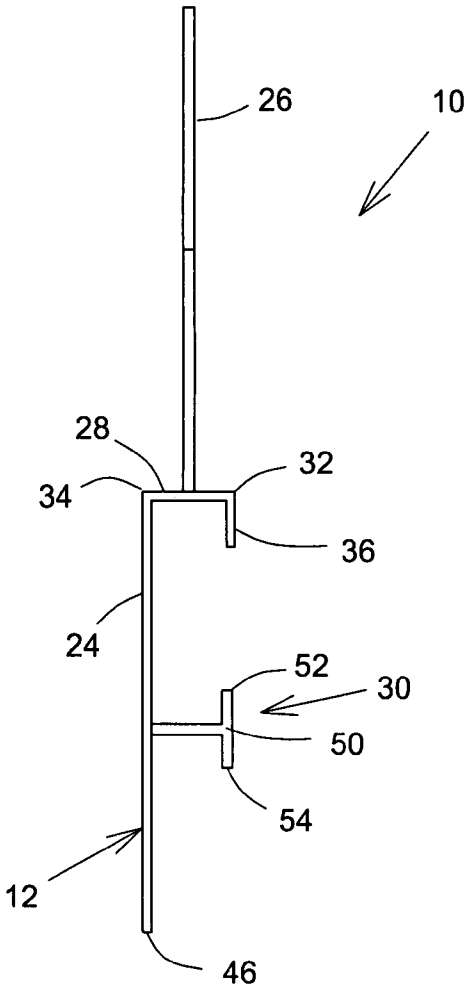
FIG. 3 is a end view taken along line 3-3 of FIG. 2.
Figure 2:
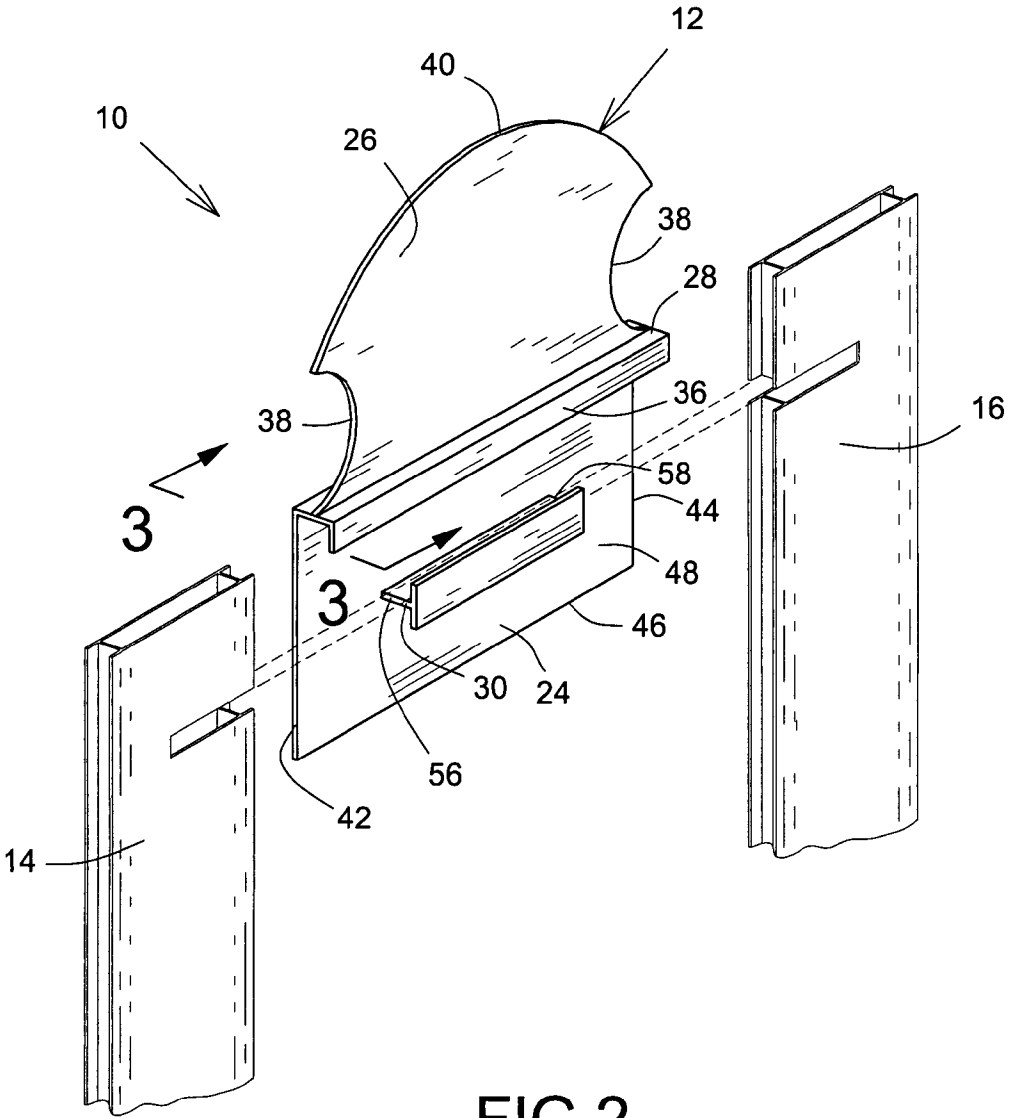
FIG. 2 is an exploded view of a retaining device.

Referring to FIGS. 2 and 3, the cap 12 includes a first distal panel 24, a second proximal panel 26, an intermediate panel 28 and a guide rail (or panel) 30. The intermediate panel 28 interconnects the distal and proximal panels 24, 26.

The intermediate panel 28 includes first and second panel edges 32, 34 and a retainer lip 36. The retainer lip 36 is connected to the first intermediate panel edge 32 at about 90 degrees and depends downwardly therefrom. The distal panel 24 is connected to the second panel edge 34 at an angle of about 90 degrees. Typically, the proximal panel 26 and distal panel 24 have approximately the same dimensions. The proximal panel 26 is typically connected to the intermediate panel 28 at a location, which is generally equidistant between the intermediate edges 32, 34, and perpendicular to the intermediate panel 28. In this embodiment, the proximal panel 26 includes two concave side edges 38 and a curved upper edge 40. The shape of the proximal panel 26 may of course be altered depending upon the esthetic appearance that is desired by the user. One skilled in the art will recognize that the proximal panel 26 may also be removed without deviating from the scope of the invention.

The distal panel 24 is connected to the second intermediate edge 34 at an angle, which is typically about 90 degrees. The distal panel 24 includes first and second distal panel side edges 42,44 and a distal panel bottom edge 46.

The guide rail 30 is connected to a distal panel face 48 at an angle, which is typically about 90 degrees. The guide rail includes a guide rail edge 50, two retainer lips 52, 54 and two stop ends 56, 58. Both the retainer lips 52, 54 are connected to the guide rail edge 50 at an angle, which is about 90 degrees. Typically, the guide rail retainer lips 52, 54 are axially aligned or coplanar with the intermediate panel retainer lip 36.

The two stop ends 56, 58 are located apart at opposite ends of the guide rail 30. The guide rail 30 extends along a portion of the face 48 of the distal panel 24 and is located generally equidistant between the distal panel bottom edge 46 and the intermediate panel 28. Typically, the intermediate panel 28 is longer than the guide rail 30, the stop ends 56, 58 being located inwardly away from the distal panel side edges 42, 44 and equidistant therefrom.

Figure 4:
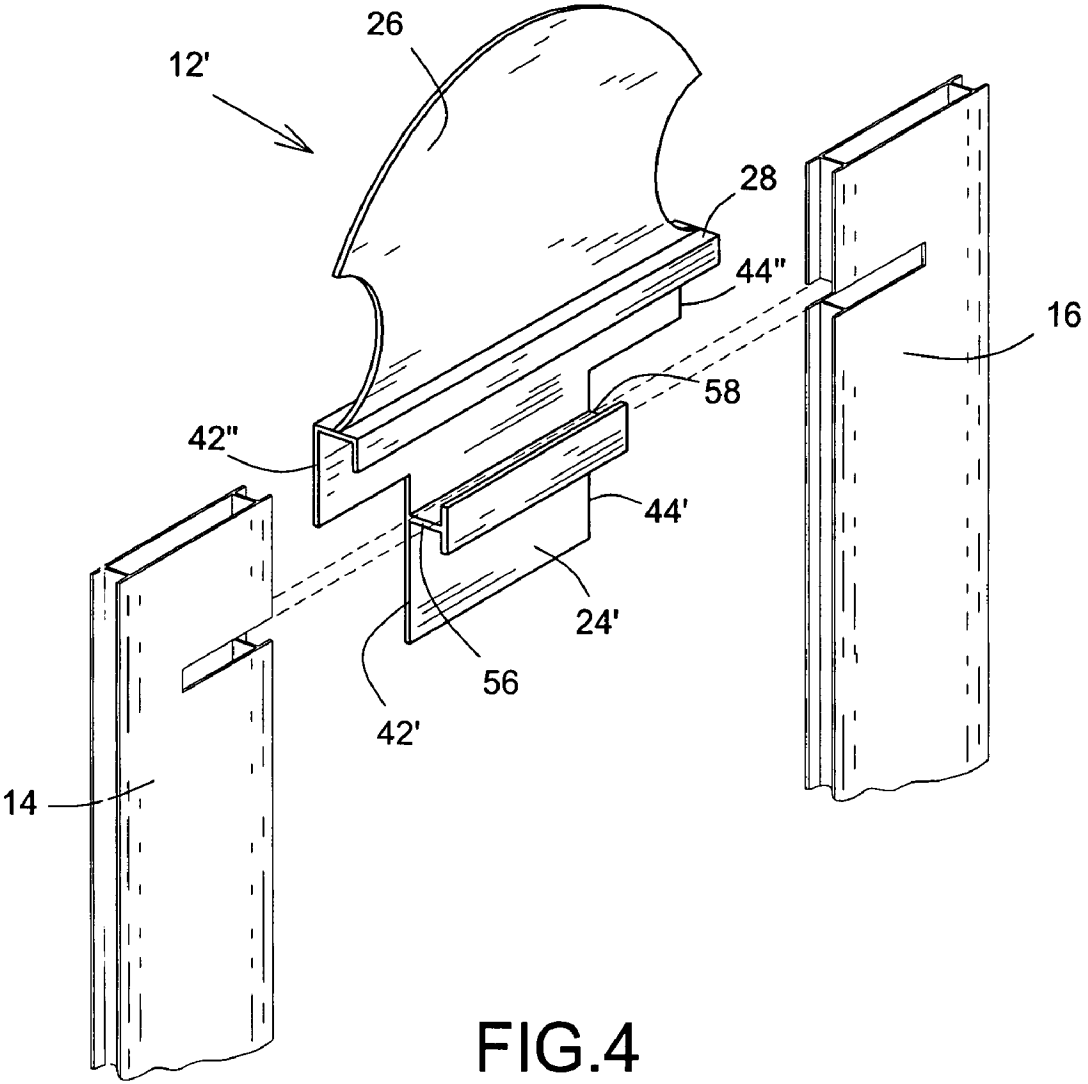
FIG. 4 is an exploded view of an alternative retaining device.
Figure 5:
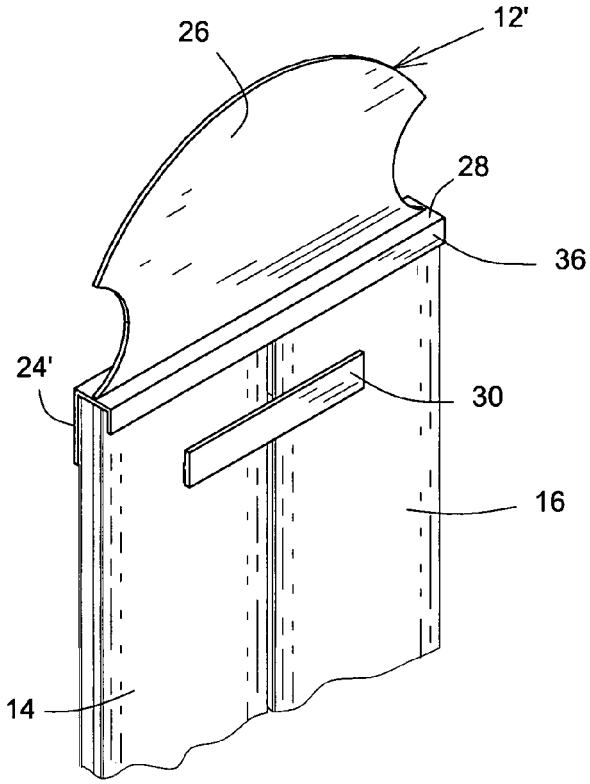
FIG. 5 is a partial perspective view of a retaining device in a retaining configuration.

As illustrated in FIG. 4, in a variation of the cap 12', with a T-shaped distal panel 24', the distal panel side edges 42, 44 are cut so that they have respective recess portions 42', 44' both adjacent the respective stops ends 56, 58. In this variation, the length of the distal panel bottom edge 46 is the same as the guide rail 30 length, both lengths being shorter than the intermediate panel 28 length.

Figure 6:
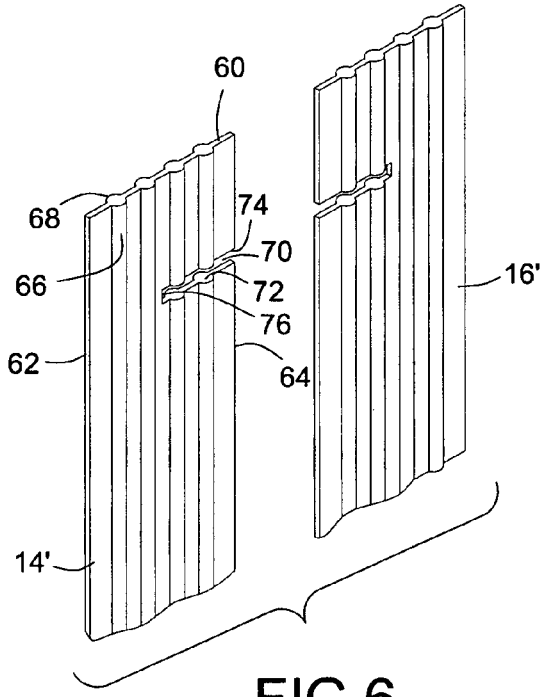
FIG. 6 is a partial perspective view of two solid elongated slats.
Figure 7:
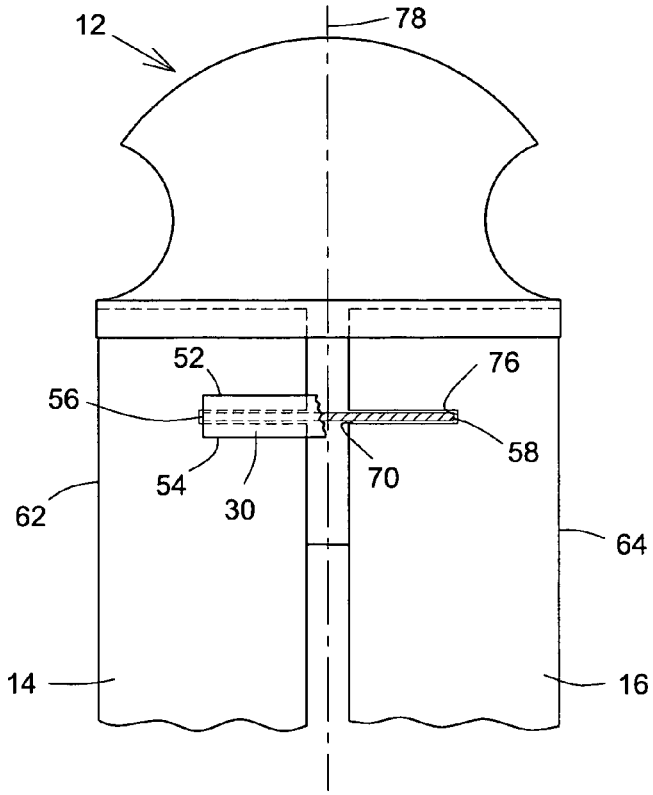
FIG. 7 is a partial cutaway front view of the retaining device.

Referring now to FIGS. 4, 6 and 7, since both elongated slats 14, 16 (and 14', 16') are essentially identical, only the slat 14 will be described in detail. The elongated slat 14 includes a slat end 60, slat edges 62, 64 and respective wide slat faces 66, 68. A notch 70 is cut into a portion of the slat end 60, typically up a position equidistant between the slat edges 62, 64. The notch 70 is defined by two sidewalls 72, 74 and a blind end 76, which define a notch opening, which is of sufficient size to cooperate with the guide rail 30 and to slide over the surfaces of the guide rail 30. The movement of the guide rail 30 is restricted because of the presence of the blind end 76 abuts the stop end 56, as will be described below. The notch side walls 72, 74 typically frictionally engage the surfaces of the guide rail 30 and retain the guide rail thereupon. The guide rail 30 has a width that enables either thin, solid elongated slats (as shown in FIG. 6), known to those skilled in the art, to move laterally over the surface of the guide rail 30. The retainer lips 36, 52, and 54, prevent the thin elongated slats from laterally disengaging the guide rail 30 or, when hollow elongated slats (as shown in FIG. 4), known to those skilled in the art, are used form a snug fit therewith by frictionally engaging the slat faces 66, 68. Similarly, the notch 70 can be cut to various sizes to accommodate either the thin elongated slats or the hollow slats.

OPERATION

Referring now to FIGS. 2 and 7, a typical operation of the device 10 will now be described. The user positions two slats 14, 16 adjacent each other in the chain link fence and locates the cap 12 between the two slats 14, 16. When the two notches 70 are essentially aligned with the guide rail stop ends 56, 58, the user applies a lateral force to both, or one, of the slat's edges 62, 64 and pushes them along the guide rail 30 towards the line of symmetry 78 in a displacement generally parallel to the distal panel 24. When the slats 14, 16 have reached the cap's line of symmetry 78, the notch blind ends 76 abut the stop ends of the guide rail 56, 58 and limits or restricts further travel towards the line of symmetry 78. The outer edges 62, 64 of the slats 14, 16 are then flush with the edge of the cap 12. For disassembly, the user applies an opposite lateral pulling force to the slats 14, 16 to move them away from the line of symmetry 78.

I claim:

1. A retaining device for use with two elongated slats longitudinally located in a chain linked fence, each elongated slat having opposed first and second longitudinal slat surfaces and opposed first and second longitudinal slat edges, each elongated slat having a notch located in a portion of a slat end, the notch extending transversally from the first slat edge substantially toward the second slat edge, said device comprising:

a cap member including:

a first panel having generally opposite first and second panel side edges and a first panel surface thereof, an intermediate panel including first and second intermediate panel edges and a first retainer lip connected to said first intermediate panel edge at about 90 degrees depending therefrom, with said first panel connected to said second intermediate panel edge at about 90 degrees relative thereto, said intermediate panel extending outwardly from said first panel surface; and a second panel, said second panel being connected to said intermediate panel at a location generally equidistant between said first and second intermediate panel edges and offset from said first panel; and a guide rail connected to said first panel, said guide rail extending along said first panel and outwardly from said first panel surface, said guide rail having first and second spaced apart longitudinal stop ends located inwardly away from respective said first and second panel side edges, said guide rail being configured to be engaged within the notches of the two slats as the two slats are moved toward one another from the first and second stop ends of the guide rail with an opening formed in each of the slats by the notch located in a portion of the slat sliding over the guide rail, said guide rail including a guide rail edge, a second retainer lip connected to said guide rail edge at about 90 degrees relative thereto, said guide rail edge and said second retainer lip substantially extending from said first stop end to said second stop end, a third retainer lip substantially opposed to said first retainer lip and connected to said guide rail edge at about 90 degrees relative thereto, said third retainer lip substantially extending from said first stop end to said second stop end.

2. The device, according to claim 1, in which said guide rail is connected to said first panel at about 90 degrees relative thereto.

3. The device, according to claim 1, in which said guide rail is of sufficient size to accommodate elongated slats of various dimensions.

4. The device, according to claim 1, in which said second panel is connected substantially perpendicular to said intermediate panel.

5. The device, according to claim 1, in which said first and second stop ends are located equidistant from respective said first and second panel side edges.

6. The device, according to claim 5, in which said first panel is a generally T-shaped panel and said first and second panel side edges are divided into first and second panel short side edges and first and second recess side edges inwardly recessed from respective said first and second panel short side edges, said first and second stop ends being located adjacent respective said first and second recess side edges, a distance between said first and second panel recess side edges being of a length narrower than a length of said intermediate panel between said first and second panel short side edges.

7. The device, according to claim 1, in which said first panel includes a panel bottom edge disposed away from said intermediate panel, said guide rail being located generally equidistant between said panel bottom edge and said intermediate panel.

8. The device, according to claim 4, in which said second panel includes two concave side edges and a convex upper edge therebetween.

9. The device, according to claim 1, in which said cap member is sized to be located over both slats when said device retains said slats thereon.

* * * * *